US005826976A

United States Patent [19]

Skratulia

[11] Patent Number: 5,826,976

[45] Date of Patent: Oct. 27, 1998

[54] BANKING METHOD FOR WAGERING GAMES

[76] Inventor: John Skratulia, 11402 Howard St., Whittier, Calif. 90601

[21] Appl. No.: 557,365

[22] Filed: Nov. 13, 1995

[51] Int. Cl.[6] ..... A63F 1/00

[52] U.S. Cl. ..... 364/412

[58] Field of Search ..... 364/410, 412; 235/379; 273/274, 292

[56] References Cited

U.S. PATENT DOCUMENTS 5,559,312 9/1996 Lucero ..... 364/412

5,569,082 10/1996 Kaye ..... 364/412

*Primary Examiner*—George Manuel

*Attorney, Agent, or Firm*—Timothy T. Tyson; Ted Masters

[57] ABSTRACT

An improved banking method for wagering games having a player-banker includes the selection of a secondary player-banker who replaces the player-banker in the event that the remaining bank (amount at risk) of the original player-banker is reduced to zero. The secondary player-banker sequentially continues to compare hands and settle wagers with the remaining players who have not as yet received "action". In a preferred embodiment, the secondary player-banker is selected from the group of players who have not yet compared hands with the player-banker, the selected secondary player-banker being the player from this group who has placed the largest wager.

18 Claims, 3 Drawing Sheets

TO STEP 38 SHEET 2 OF 2

BANKING METHOD FOR WAGERING GAMES

TECHNICAL FIELD

The present invention pertains generally to wagering games and more particularly to an improved banking method which may be applied to any existing wagering game which includes the feature of a player-banker.

BACKGROUND ART

Numerous wagering games include the feature of a player-banker who sequentially plays against a plurality of other players. Such games are prevalent in regions which legally prohibit gambling games which include a participating house dealer (for example California). In these games, the player-banker makes a wager which is usually much larger than the individual wagers of the other players, and which defines a bank. The player-banker sequentially compares hands with the other players, and wins or loses the wager of the other player in accordance with the rules of the selected wagering game. During the course of play, the bank is incrementally reduced by the amount of each wager that is won or lost. Should the bank be reduced to zero, the round of play is immediately concluded, whether or not all players have participated (received "action"). The present invention virtually eliminates this undesirable occurrence by the establishing a secondary player-banker, who takes over for the player-banker should the bank be reduced to zero. No prior art relating to the present invention has been identified.

DISCLOSURE OF INVENTION

The present invention is directed to an improved banking method which may be applied to any wagering game which includes the feature of a player-banker. The invention comprises the determination of a secondary player-banker who replaces the player-banker in the event that the remaining bank (also called "amount at risk") of the original player-banker is reduced to zero before all players have had their wagers settled. The selected secondary player-banker continues comparing hands and settling wagers with those players who have not had their wagers settled. The present invention thereby avoids the frustration associated with a player having a strong hand and not having a opportunity to play (receive "action"). Further the casino or gaming establishment will increase revenue since considerably fewer free collection buttons will be awarded.

In accordance with a preferred embodiment of the invention, in a wagering game which includes a player-banker who sequentially plays against a plurality of other players, a step of determining a secondary-player banker is added. If at some point during the play of the game, the remaining bank of the player-banker is reduced to zero, the wagers of the remaining players cannot be settled. In this event, the secondary player-banker takes over by replacing the player-banker and sequentially continues comparing hands and settling wagers with the remaining players.

In accordance with an important aspect of the invention, the secondary player-banker is selected from the group of players who have not yet compared hands with the player-banker, the selected secondary player-banker being the player from this group who has placed a largest wager.

In accordance with an important feature of the invention, if two or more players have each placed the largest wager, the first sequential player becomes the secondary player-banker.

In accordance with another important aspect of the invention, the group of players from which the secondary player-banker is selected further includes the player who was comparing hands and settling a wager with the player-banker at the time the remaining bank was reduced to zero, and whose wager was not fully settled.

In accordance with another important feature of the invention, if exactly two players have not compared hands and settled wagers with the player-banker, the first sequential player becomes the secondary player-banker.

In accordance with an important aspect of the invention, the remaining players include those players who have not compared hands with the player-banker.

In accordance with an important feature of the invention, the remaining players include those players who have not compared hands with the player-banker, and further include the player who was comparing hands and settling a wager with the player-banker at the time the remaining bank was reduced to zero, and whose wager was not fully settled.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1:
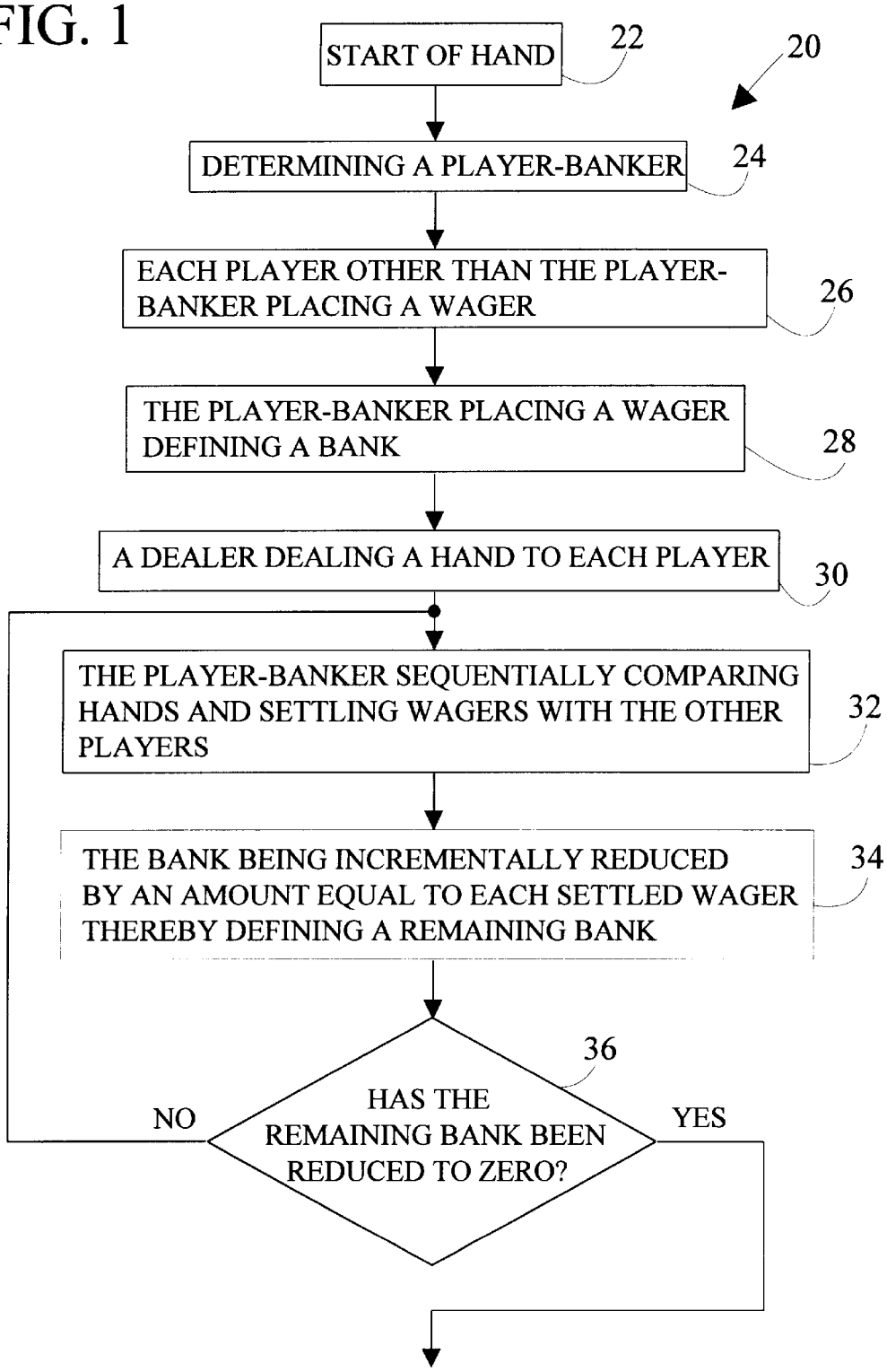
FIG. 1 and 1A is a flow diagram illustrating the steps and method of play of an improved banking method in accordance with the present invention; and, FIG. 2 is a plan view of a playing table layout.
Figure 1A:
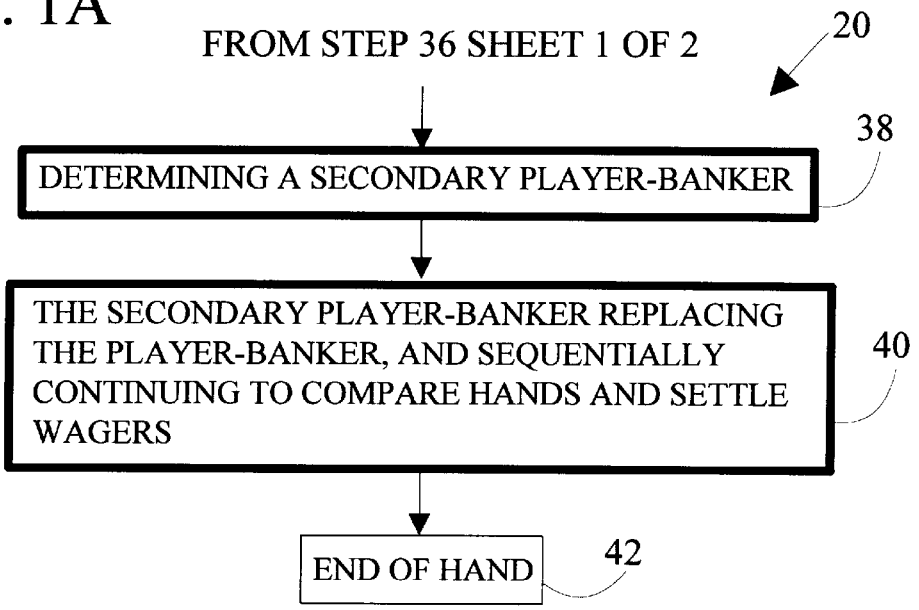
Figure 2:
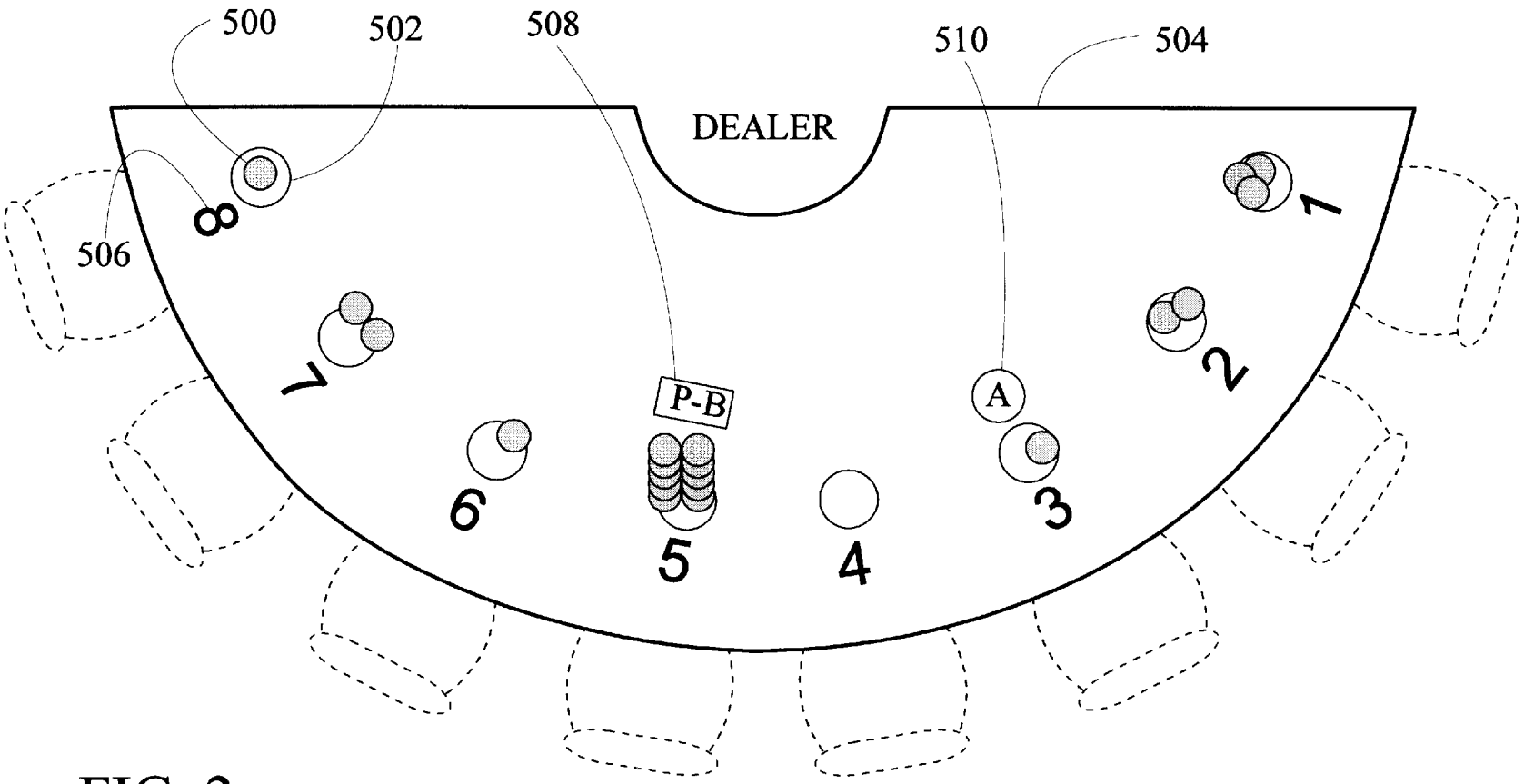

Referring initially to FIGS. 1 and 2, there are depicted a flow diagram and playing table layout illustrating the steps and method of play of an improved banking method in accordance with the present invention, generally designated as 20. The new improved steps 38 and 40 are shown with heavy borders, whereas the steps of the existing wagering game are shown with light borders. The steps of the existing wagering game as illustrated in FIG. 1 depict a typical method of playing any game (for example Pai Gow Poker, Pan Nine, Calififfornia Blackjack, etc.) which includes a player-banker, who sequentially plays against a plurality of other players. It may be appreciated that other playing variations of the existing wagering game including additional steps, deletion of steps, or rearrangement of steps are also possible. Referring to FIG. 1 and also to FIG. 2, a hand begins with start terminator step 22. In step 24 a player-banker is determined by methods well known in the gaming art. The player-banker is also sometimes known as the banker or bank hand. In step 26, each of the players other than the player banker place a wager 500 in betting areas 502 directly in front of them on playing table 504 as shown in FIG. 2. In step 28 the player-banker places a wager 500 which defines a bank. It is noted that steps 26 and 28 may be reversed wherein the other players place their wagers 500 before the player-banker places a wager 500, or steps 26 and 28 may be performed simultaneously. The playing table 504 includes a plurality of numbered playing positions 506, eight in the shown embodiment. Indicia depicting the betting areas 502, playing positions 506, or other pertinent information can be disposed upon the surface of the playing table 504 or a covering thereof. A player-banker marker 508 is placed in front of the player-banker, and an action player marker (button) 510 is placed in front of the selected action-player. For simplicity, in FIG. 2 wagers 500, betting areas 502, and playing positions 506 have only been depicted for one player.

In step 30 a dealer deals a hand of the selected wagering game to each player including the player-banker. In step 32 the player-banker sequentially compares hands and settles wagers with the plurality of other players, the comparing and settling usually beginning with the action player. In step 34 the bank is incrementally reduced by an amount equal to each settled wager 500 thereby defining a remaining bank (also called an "amount at risk"). That is, each time a wager 500 is settled, regardless whether the player-banker or the player wins, the bank (or subsequently the remaining bank) is reduced by the amount of the wager 500 which is won or lost. If the player-banker and the player tie (push), the bank (or subsequently the remaining bank) is not reduced. In step 36 it is determined if the remaining bank has been reduced to zero. If "NO", steps 32, 34, and 36 are repeated. If "YES", and at some point during play the remaining bank is reduced to zero so that the wagers 500 of all the players cannot be settled, play proceeds to step 38 wherein a secondary player-banker is determined. In step 40 the secondary player-banker replaces the player-banker, and sequentially continues to compare hands and settle wagers with the remaining players.

For example, in FIG. 2 the comparing of hands and settling of wagers 500 would commence with the action player (the player occupying playing position 506 3). Assuming that action player 3 has the better hand, then the action player would win one unit from the player-banker (player 5), and the original bank of ten units would be reduced by one unit resulting in a remaining bank of nine units. The player-banker would next compare hands and settle the wager 500 of player 6 who has also wagered one unit. Assuming that player 6 loses to the player-banker, the remaining bank would be reduced by one unit to eight units. The player-banker would next compare hands and settle the wager 500 of player 7 who has wagered two units. Assuming that player 7 wins the wager, the remaining bank would be reduced to six units. The player-banker would next compare hands and settle the wager of player 8. Assuming that the player-banker and player 8 tie (push), the remaining bank would not be reduced since no wager was won or lost, but rather it would remain at six units and the player-banker would next compare hands and settle the wager 500 of player 1. Assuming that player 1 loses, the remaining bank would be reduced by three units to three units. And finally, assuming that player 2 wins, the remaining bank would be reduced to one unit.

It should be pointed out that it is the lesser of the remaining bank and the wager 500 of the contending player which determines the amount of the wager 500 which is won or lost. From time to time in the play of the game, the remaining bank is reduced to a level which is less than the wager 500 of the next sequential player. In the previous example, the remaining bank was six units when play reached player 1. If player 1 had wagered seven units instead of three units, the amount of the wager 500 which is to be won or lost would be the amount of the remaining bank (six units) which is the lesser of the remaining bank and the seven unit wager 500 of player 7. In other words, player 1 only receives partial "action" on his/her seven unit wager 500. Furthermore, if either the player-banker or player 7 wins the six unit wager 500, the remaining bank would be reduced to zero so that the wagers 500 of the remaining players cannot be settled, and the hand (round of play) immediately concluded. Therefore, player 2, the remaining player, would not get a chance to participate in the hand at all.

In order to avoid this undesirable occurrence, the present invention includes an additional step of determining a secondary player-banker who, when the remaining bank is reduced to zero, replaces the player-banker and sequentially continues to compare hands and settle wagers 500 with those players who did not compare hands with the player-banker. The secondary player-banker utilizes his/her wager 500 to establish a secondary bank and sequentially compare hands and settle wagers 500 with the remaining players. This feature ensures that all players can expect to receive "action" on almost every hand (round of play). In an alternative embodiment, the secondary player-banker also compares hands and settles wagers 500 with the player who was comparing hands and settling a wager 500 with the player-banker at the time the remaining bank was reduced to zero, and whose wager 500 was not fully settled. In a preferred embodiment, the secondary player-banker is selected from the group of players who have not yet compared hands with the player-banker, the selected secondary player-banker being the player from this group who has placed the largest wager 500. By selecting the player who has placed the largest wager 500, it is more likely that all players will receive "action". If two or more players have each placed the largest wager 500, the first sequential player (the player nearest to the action player) becomes the secondary player-banker. In an alternative embodiment, the group of players from which the secondary player-banker is selected further includes the player who was comparing hands and settling a wager 500 with the player-banker at the time the remaining bank was reduced to zero, and whose wager 500 was not fully settled. Again, if two or more players have each placed the largest wager 500, the first sequential player becomes the secondary player-banker. In another preferred embodiment, if the remaining bank is reduced to zero, and exactly two players have not compared hands and settled agers 500 with the player-banker, the first sequential layer becomes the secondary player-banker.

By way of example, assume that in a wagering game the layers have made the following wagers 500:

Player 1—$100
Player 2—$1,000 (the player-banker)
Player 3—$200
Player 4—$400 (the action player)
Player 5—$500
Player 6—$200
Player 7—$200
Player 8—$700

Play commences with the player-banker (player 2) comparing hands and settling the wager 500 of player 4, the action player. Assuming player 4 wins, the $1,000 bank is reduced by $400 forming a remaining bank (or amount at risk) of $600. The player-banker next compares hands and settles the wager 500 of player 5. Assuming player 5 loses, the $600 remaining bank is reduced by $500 to $100.

The player-banker next compares hands and settles the wager 500 of player 6. However, since the amount in the remaining bank ($100) is less than the $200 wager 500 of player 6, the lesser amount of $100 defines the amount to be won or lost. Assuming that player 6 wins the $100 wager 500, his/her wager 500 not being fully settled therefore receiving only partial "action", the remaining bank is reduced to zero, and under existing wagering methodology the game would be immediately concluded, and players 7, 8, 1, and 3 would not participate in the hand (not receive "action").

However, with the improved wagering method of the present invention however, the game can continue. When the remaining bank is reduced to zero, a secondary player-banker is selected from the group of players who have not as yet compared hands and settled wagers 500 with the player-banker (the remaining players). In this example the group consist of players 7, 8, 1, and 3. Of this group, the player who has placed the largest wager 500, player 8, is selected as the secondary player-banker, with player 8's wager of $700 now defining a secondary bank. Player 8 replaces player 2 and continues to sequentially compare hands and settle wagers 500 with the other remaining players, that is players 7, 1, and 3, using the secondary bank to do so. Player 8 first compares hands and settles the wager 500 of player 7. Assuming player 8 wins, the secondary bank is reduced by $200 resulting in a remaining secondary bank of $500. The secondary player-banker next compares hands and settles the wager 500 of player 1. Assuming that player 1 wins, the remaining secondary bank is reduced by $100 to $400, which is sufficient to cover the wager 500 of the only remaining player, player 3. Lastly, the secondary player-banker compares hands and settles the wager 500 of player 3. It is noted that in this instance the secondary bank was sufficiently large so as to permit all players to receive "action" on the hand. With the present invention, this will be the case most of the time.

As was previously stated, the wager 500 of the secondary player-banker defines a secondary bank which is similarly reduced by the amount of each settled wager 500 resulting in a remaining secondary bank. In the unlikely event that the remaining secondary bank is reduced to zero, the hand is concluded, although in theory it would be entirely possible to similarly establish a third player-banker. The secondary player-banker therefore continues to compare hands and settle wagers with the remaining players until either (1) all players have participated, or (2) until the remaining secondary bank of the secondary player-banker is reduced to zero. The game then proceeds to end terminator 42.

Oftentimes the play of the existing wagering game further includes a step of determining an action players Depending somewhat upon the game being played, the action player is usually the first player to be dealt cards, draw cards, and compare and settle a wager with the player-banker. Also, the comparing of hands and settling of wagers can proceed in a clockwise direction which is preferred, or in a counterclockwise direction.

It may be appreciated that the secondary player-banker could be given other names such as supplemental player-banker, supplemental banker, second player-banker, second banker, alternative player-banker, alternative banker, etc., all of which could be used to describe the secondary player-banker concept disclosed herein.

Very importantly, the secondary player-banker and secondary bank should not be confused with the term "second bank" which is sometimes used in existing wagering games to describe a backline wager 500 in support of the player-banker. Such "second bank" wagers 500 in effect add to the remaining bank of the player-banker while the player-banker continues to play the came. The present invention on the other hand replaces the player-banker altogether with a secondary player-banker who uses his/her wager to form a secondary bank, and who compares hands and settles wagers 500 with the remaining players.

The preferred embodiments of the invention described herein are exemplary and numerous modifications, procedural variations, rearrangements, and adjustments can be readily envisioned to achieve an equivalent result, all of which are intended to be embraced within the scope of the appended claims.

I claim:

1. An improved banking method for existing wagering games which include a player-banker who sequentially plays against a plurality of other players, the existing wagering games including the steps of:

each player other than the player-banker placing a wager;

the player-banker placing a wager defining a bank;

a dealer dealing a hand to each player;

the player-banker sequentially comparing hands and settling said wagers with the plurality of other players;

said bank being incrementally reduced by an amount equal to each said settled wager thereby defining a remaining bank;

at some point during play, said remaining bank being reduced to zero so that said wagers of all the players cannot be settled; said improved banking method comprising:

a secondary player-banker replacing the player banker and sequentially continuing to compare hands and settle wagers.

2. The method according to claim 1, wherein said secondary player-banker is selected from a group of players who have not compared hands with the player-banker, said selected secondary player-banker being the player from said group who has placed a largest said wager.

3. The method according to claim 2, wherein if two or more players have each placed said largest wager, the first sequential player becoming said secondary player-banker.

4. The method according to claim 2, the group of players further including the player who was comparing hands and settling said wager with the player-banker at the time said remaining bank was reduced to zero, and whose wager was not fully settled.

5. The method according to claim 4, wherein if two or more players have each placed said largest wager, the first sequential player becoming said secondary player-banker.

6. The method according to claim 1, wherein if exactly two players have not compared hands and settled said wagers with the player-banker, the first sequential player becoming said secondary player-banker.

7. The method according to claim 1, wherein said step of said secondary player-banker replacing the player banker and sequentially continuing to compare hands and settle wagers, includes comparing hands and settling wagers with those players who did not compare hands with the player-banker.

8. The method according to claim 1, wherein said step of said secondary player-banker replacing the player banker and sequentially continuing to compare hands and settle wagers, includes comparing hands and settling wagers with those players who did not compare hands with the player-banker, and further includes comparing hands and settling wagers with the player who was settling a wager with the player-banker at the time said remaining bank was reduced to zero, and whose wager was not fully settled.

9. The method according to claim 1, further including the step of determining an action player, the step of the player-banker sequentially comparing hands and settling said wagers with the plurality of other players commencing with the action player.

10. The method according to claim 1, wherein sequentially comparing hands and settling said wagers proceeds in a clockwise direction.

11. The method according to claim 1, wherein sequentially comparing hands and settling said wagers proceeds in a counterclockwise direction.

12. In a wagering game having a player-banker who sequentially plays against a plurality of other players, the player-banker having a remaining bank which is used to settle the wagers of the other players, and the remaining bank having been reduced to zero before all players have had their wagers settled, an improved banking method comprising the steps of:

a secondary player-banker replacing the player-banker;

said secondary player-banker utilizing his/her said wager to form a secondary bank; and, said secondary player-banker sequentially comparing hands and settling wagers with those players who have not compared hands with the player-banker.

13. The improved banking method according to claim 12, wherein said secondary player-banker additionally compares hands and settles wagers with the player who was comparing hands and settling a wager with the player-banker at the time the remaining bank was reduced to zero, and whose wager was not fully settled.

14. An improved wagering method for use in wagering games having a player-banker who plays against the other players, wherein the remaining bank of the player-banker has been reduced to zero thereby leaving at least one remaining player who has not yet played, comprising the step of:

a secondary player-banker replacing the player-banker and continuing play against the remaining players.

15. An improved banking method for existing wagering games which include a player-banker who sequentially plays against a plurality of other players, the existing wagering games including the steps of:

each player other than the player-banker placing a wager;

the player-banker placing a wager defining a bank;

a dealer dealing a hand to each player;

the player-banker sequentially comparing hands and settling said wagers with the plurality of other players;

said bank being incrementally reduced by an amount equal to each said settled wager thereby defining a remaining bank;

at some point during play, said remaining bank being reduced to zero so that said wagers of all the players cannot be settled; said improved banking method comprising:

a secondary player-banker replacing the player banker and sequentially continuing to compare hands and settle wagers; and, wherein said secondary player-banker is selected from a group of players who have not compared hands with the player-banker, said selected secondary player-banker being the player from said group who has placed a largest said wager.

16. The method according to claim 15, wherein if two or more players have each placed said largest wager, the first sequential player becoming said secondary player-banker.

17. The method according to claim 15, the group of players further including the player who was comparing hands and settling said wager with the player-banker at the time said remaining bank was reduced to zero, and whose wager was not fully settled.

18. The method according to claim 17, wherein if two or more players have each placed said largest wager, the first sequential player becoming said secondary player-banker.

* * * * *